US008371952B2

(12) United States Patent
Nemeth et al.

(10) Patent No.: US 8,371,952 B2
(45) Date of Patent: Feb. 12, 2013

(54) ROUND RIDE WITH CONTOURED AND ROTATING TRACK

(75) Inventors: Edward A. Nemeth, Hermosa Beach, CA (US); David W. Crawford, Long Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 297 days.

(21) Appl. No.: 12/984,383

(22) Filed: Jan. 4, 2011

(65) Prior Publication Data

US 2012/0172139 A1 Jul. 5, 2012

(51) Int. Cl.
*A63G 1/34* (2006.01)
*A63G 1/08* (2006.01)

(52) U.S. Cl. ..... 472/40; 472/47

(58) Field of Classification Search ..... 472/3, 27–29, 472/40–43, 45, 47, 48, 88, 91; 104/53, 58, 104/81

See application file for complete search history.

(56) References Cited

U.S. PATENT DOCUMENTS

| | | | | |
|---|---|---|---|---|
| 923,489 | A * | 6/1909 | Chance | 472/28 |
| 3,297,319 | A * | 1/1967 | Chereau | 472/37 |
| 3,666,264 | A * | 5/1972 | Bartlett | 472/3 |
| 3,724,842 | A * | 4/1973 | Wisdom | 472/3 |
| 5,184,980 | A * | 2/1993 | Ferris | 472/91 |
| 6,939,236 | B2 * | 9/2005 | McLaren et al. | 472/90 |
| 7,918,740 | B2 * | 4/2011 | Kitchen et al. | 472/36 |

* cited by examiner

*Primary Examiner* — Kien Nguyen
(74) *Attorney, Agent, or Firm* — Marsh Fischmann & Breyfogle, LLP; Kent A. Lembke

(57) ABSTRACT

A round ride that creates a rotating ride experience with a varying frequency of vehicle elevations. The round ride includes a central hub assembly with a hub and a hub drive that rotates the hub about a central axis at a hub rotation rate. The drive assembly includes support arms extending outward from the hub, upon which are mounted passenger vehicles. The support arms are pivotally mounted to the hub. The round ride includes a track structure with a ring-shaped running surface extending about the central axis and with a track drive rotating the running surface about the central axis at a track rotation rate in the same or differing direction and rate as the hub. The vehicles are vertically supported by the running surface which is contoured to define a series of hills and valleys, and the running surface and the hub are independently rotated about the central axis.

20 Claims, 8 Drawing Sheets

ROUND RIDE WITH CONTOURED AND ROTATING TRACK

BACKGROUND

1. Field of the Description

The present description relates, in general, to amusement park rides and other entertainment rides such as round rides, and, more particularly, to amusement or theme park rides configured to provide passengers with varying and unpredictable ride experiences while utilizing a rotating central hub to move vehicles about a central axis.

2. Relevant Background

Amusement and theme parks are popular worldwide with hundreds of millions of people visiting the parks each year. However, park operators continuously seek new designs for rides that attract and continue to entertain guests. Many parks include round rides that include vehicles or gondolas mounted on support arms extending outward from a centrally located drive or rotation assembly. The passengers or riders sit in the vehicles and are rotated in a circle about the drive assembly, which spins about its central axis.

While these rides are popular with younger children, these rides are typically not considered an exciting ride that appeals to older guests as the rides often rotate at less than 10 revolutions per minute (RPM) and provide less sophisticated mental stimulation. In some of these rides, the guests may operate an interactive device, such as a joystick in the vehicle, to make the support arm and their attached vehicle gradually move upward or downward. Some rides also allow the guests to control the pitch of their vehicle. In other round rides, the vehicles are rotated on a fixed track that may have raised portions or "hills" that the vehicle rolls over to try to add some differing ride experiences. However, since the track is fixed and the central hub is rotated at a fixed speed, the ride is very cyclic and predictable as the rider of the vehicle has experienced all the variations of the ride after one single rotation of the hub. After that first loop, the ride is repetitive in nature.

While existing round rides provide an enjoyable experience, the relatively low rotation rate and "generic" or overly predictable experiences have been significant barriers to the variability of thrill or excitement that could be provided with a ride based on a round ride design (e.g., one with a central rotating hub and vehicles supported upon arms extending out from the hub). As a consequence, park operators desire a more exciting and variable ride that retains the simplicity, affordability, and appeal for multi-arm rotating rides while increasing passenger enjoyment for all ages such as by increasing the thrill-factor and/or by providing a more variable and less predictable ride experience.

SUMMARY

The present invention addresses the above problems by providing a round ride that may be thought of as a "Doppler Rotator." The round ride described herein includes a rotating hub to which a number of arms are pivotally attached, and a passenger vehicle is provided on the end of each arm so as to rotate with the hub about a vertical center axis. In contrast, though, the arms are not actuated to pivot about their hub connection point. Instead, the round ride includes a track structure with an independent drive. The track structure includes a ring or doughnut-shaped running surface extending about the center axis, and this running surface is independently rotated about the center axis. Significantly, the running surface is contoured with one, two, or more spaced apart hills or raised portions, and the vehicles are vertically supported by this running surface such that their heights or elevations are changed as the vehicles pass over the running surface. The running surface may be rotated in the same or opposite direction as the hub and at the same or differing rotation rates to provide a widely variable and unpredictable ride experience to the passengers. Alternatively, the system may be configured such that the vehicles are self-propelled along the track.

More particularly, a ride apparatus or round ride is provided that creates a ride profile or experience with a frequency of vehicle elevation changes that can be varied with each hub rotation (e.g., to avoid a predictable cyclic experience). The round ride includes a central hub assembly with a hub and a hub drive that rotates the hub about a central axis at a hub rotation rate. The drive assembly may include a plurality of support arms extending outward from the structure. The round ride further includes a plurality of passenger vehicles each mounted proximate to an end of one of the support arms distal to the drive assembly. In the round ride, each of the support arms is pivotally mounted to the structure for angular rotation to change a height of the corresponding vehicle with movement of the support arm. The round ride also includes a track structure with a ring-Shaped running surface extending about the central axis at a track radius and with a track drive rotating the running surface about the central axis at a track rotation rate. In the round ride, the vehicles are vertically supported by the running surface. Also, the running surface and the hub are independently rotated about the central axis.

In some embodiments, the running surface is contoured to provide at least two surfaces with differing heights relative to a horizontal plane extending through the central axis. In other cases, the running surface includes at least two spaced apart, raised portions with first and second heights that differ from each other. In some embodiments, the hub drive is operable to rotate the hub about the central axis in a first direction and the track drive is operable to rotate the hub about the central axis in a second direction that is opposite the first direction. In some cases, the track rotation rate is a non-multiple of the hub rotation rate, and, in other cases, the track rotation rate differs from the hub rotation rate. In some embodiments, each of the vehicles is vertically supported by the running surface via running gear provided on each of the vehicles that contact the running surface. In other cases, though, each of the vehicles is vertically supported by the running surface in a cantilevered manner by a contact element, provided on the support arm at a location inboard of the mounting end of the arm, that rides on the running surface.

DETAILED DESCRIPTION

Figure 1:
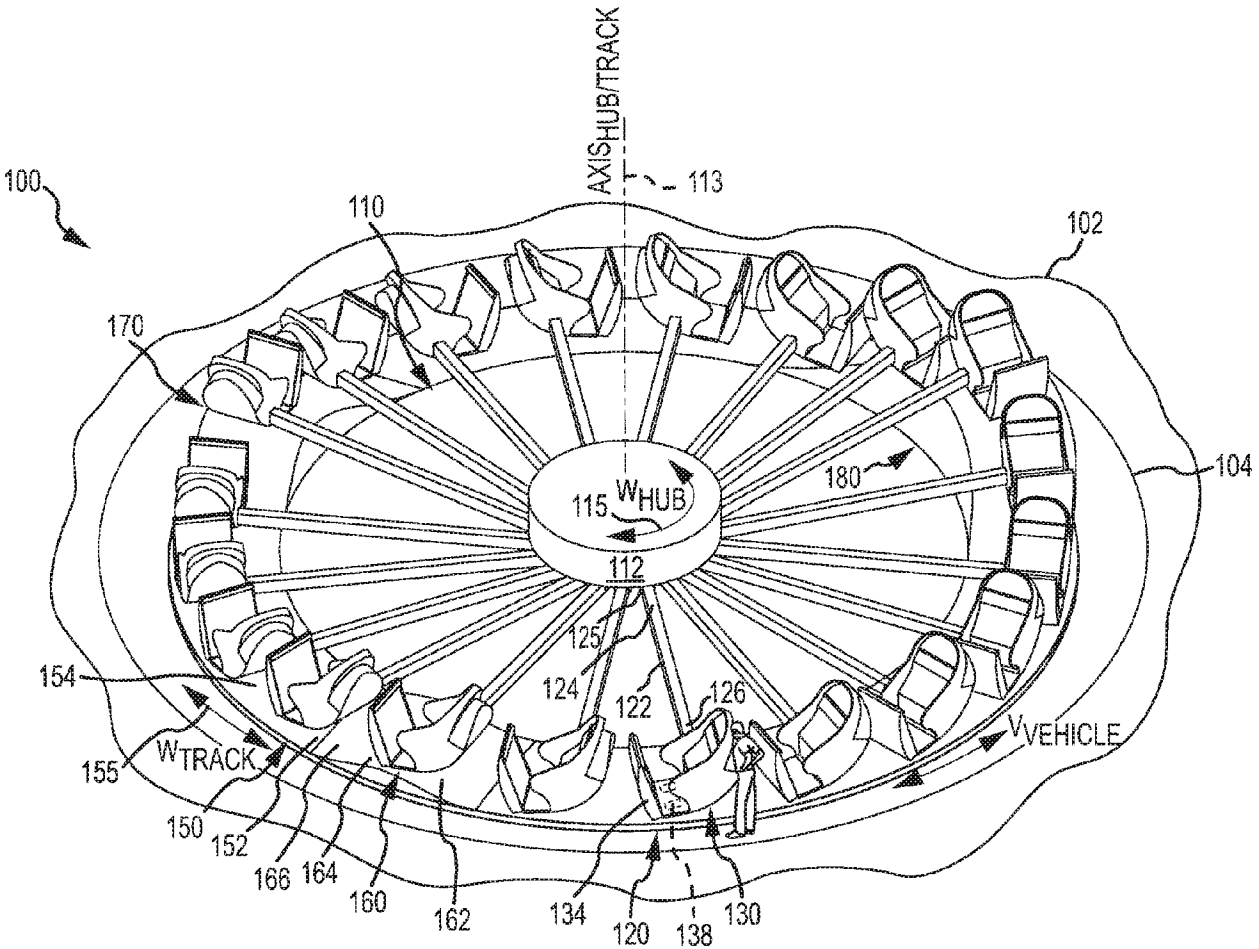
FIG. 1 is a top perspective view of a theme or amusement park ride (or, interchangeably, a park ride, a ride, a round ride, a Doppler rotator, or the like) with multiple support arms extending outward from a centrally located drive and support assembly to support passenger vehicles/compartments on a rotating hub and also with a track structure that supports the vehicles and rotates about the hub's rotation axis in a like or differing rotation direction.

Briefly, the description is directed to an amusement park ride that provides enhanced passenger or rider dynamics in a round ride by combining a moving or rotating track surface with the rotation of the hub. The track surface is contoured (with raised portions or "hills") and is used to support the rotating vehicle, and the track may be rotated in the same or opposite direction about the hub's center axis at the same or differing speeds to achieve a widely varying and unpredictable ride experience.

In more detail, the ride system (which may be thought of as a "Doppler rotator") includes a central hub that rotates about a substantially vertical axis. The ride system has multiple arms attached to the perimeter of the hub, and a passenger vehicle or compartment is attached to the free, distal end of each arm so as to be rotated about the axis during rotation of the hub. Each arm is attached to the hub through a pivoting joint (or pivotal connector) that allows the arm to freely move through a vertical angle. Further, the ride system includes a track or guide provided in the form of a concentric ring for the central hub (e.g., a ring-shaped or doughnut-shaped track spaced apart some radial distance from the outer surface or perimeter of the hub structure).

Each of the vehicles are supported by surfaces of the track or guide such as by rollers/wheels affixed to the vehicle body that contact the guide/track surfaces or by rollers provided on the support arm (instead of on the vehicle body) such that in this latter example the vehicle is cantilevered outward from the guide or track to be "free flying." In the cantilevered embodiment, the track structure may be positioned at any intermediate radius between the hub and the passenger compartment or vehicle. The track surface is contoured in that it includes hills or raised portions to provide two or more track portions with two or more elevations (relative to a base or minimal track height that may coincide with load/unload in some cases). The differing track elevations force the vehicle to also rise and fall in elevation as the hub and pivotally supported arms rotate relative to the track structure. During initial operations (or periodically during the ride), the hub and track may be rotated in the same direction and at the same rate to provide a ride experience with a loop or portion of a loop in which no elevation change occurs (e.g., in some rotations no elevation occurs while in most there is some unpredictable amount of vertical movements). Basically, the ride system is made up of two relatively simple rotating structures that are driven by independently operable drive mechanisms (e.g., one or more drive motors for each rotatable structure).

Significantly, the ride system includes a drive device operable to rotate the track independently from the hub. In this manner, the track structure (and supporting surface for the vehicle or its support arm) can be independently rotated relative to the rotation of the hub about the center axis of the hub (e.g., the two rotation axes coincide). The rotations of the hub and track may be in the same direction or in opposite directions (e.g., one clockwise (CW) and the other counterclockwise (CCW)) and may be at the same rotation rate or speed or differing rotation rates. Further, the track may be rotated at a rate chosen specifically to not be a multiple of the hub rotation rate (e.g., be "out-of-phase") so as to achieve a non-cyclic ride experience that varies rotation to rotation of the vehicles about the center axis.

The ride systems described herein produce a ride experience that includes going up and down hills as the vehicle traversed about a circular path. However, the ride profile is not repeated for each and every loop as would be the case with a fixed track. Instead, a high degree of variability in the ride is achieved by rotating the track at differing rates (different from the hub and, in some embodiments, differing within a single operation of the ride system such as by increasing or decreasing the track rotation rate (or the hub rate)) to achieve differing effects and vehicle dynamics. The variability adds a level of passenger interest by eliminating the repetitive nature of the ride and allows a show designer to program the ride (such as with a ride program used by a ride control system to control operation of the huh and/or track drive mechanisms to control rotation rates and/or directions) in a manner that increases and decreases in intensity according to a scripted storyline, for example.

Prior to turning to particular ride system embodiments, it may be useful to explain the Doppler rotator concept of the ride system with a non-limiting example. In one embodiment, the central hub is rotated in a first direction (e.g., CW) at a first rate (e.g., 6 revolutions per minute (RPM)), and the track surface is constructed to have two hills (sloped leading and trailing ends with a rounded peak portion) that are 180 degrees apart (e.g., at cardinal points of north and south), if the track is fixed (not moving), each vehicle on the hub crosses the top of a hill every 5 seconds per revolution, once when the vehicle is at the north position and once when at the south position. This repeats for the entire duration of the ride (e.g., 90 to 120 seconds or more).

However, if the track is rotated in a CW direction (a second direction that happens in this example to be the same as the first direction) at a second rate (e.g., 3 RPM), each vehicle tops a hill every 10 seconds instead of every 5 seconds. The effective slope of the hill, as experienced by the vehicle, is also reduced by one half. In contrast, if the track is rotated in a CCW direction (i.e., the second direction is opposite the first rotation direction of the hub), each vehicle tops a hill every 2.5 seconds, and the effective slope of the hill is increased by a factor of two. Additionally, rotation of the track causes the position of the hills to change over time so that each of the vehicles rises and falls at different positions about the circumference of the hub, which causes the vehicle to be at differing heights relative to the surrounding environment to further vary the ride experience (e.g., see one set element on a first pass and see the same set element from above or below on the next rotation and so on).

With non-multiple ratios between the hub rotation rate and the track rotation rate (e.g., 2 RPM and 7 RPM, 3 RPM and 5 RPM, and the like), any individual vehicle rises and falls in elevation at differing locations or point in each lap or rotation (e.g., high at the south point of the ride, then high at an angular offset from this location in a next rotation, and so on). This provides additional show opportunities whereby individual passenger compartments or vehicles can pass by high, low, or at intermediate show elements on different laps of the ride. By varying the relative speeds and directions of rotation between the two concentric, rotating structures, an extremely diverse range of experiences can be achieved up to and including matching speed and direction, which would allow all vehicles to maintain a constant elevation for all or part of a rotation (or multiple rotations) (as may be desirable for a portion of show or ride experience to add to unpredictability of a ride or for other design reasons).

Additionally, the ride system adds a unique kinetic effect to an area when viewed by people not on the ride. The vehicles are moving in a circle and moving up and down while the "wave" created by the vehicles passing over a hill precedes to move around the hub. In some embodiments, the vehicles are supported on a running surface (or track surface) positioned directly beneath the vehicles. In other embodiments, the arms are supported by the running or track surface at some intermediate point or radius (between an inner or first end of the arm and an outer or second end proximate to the vehicle). This causes each of the vehicles to be supported on a cantilevered portion of the support arm (outer portion of the arm at a greater radius than the arm support point and, typically, the track surfaces), and the vehicles appear to be flying vehicles. With such a cantilevered or flying vehicle configuration, the support track can be built such that the track can be lowered when the ride is not in operation such that the arms come to rest on a second, fixed track, which may be designed to position all the vehicles at a common level, such as adjacent a load/unload platform, to facilitate loading and unloading of the ride.

FIG. 1 illustrates a round ride 100 according to one embodiment of this description that is adapted for providing a more dynamic ride experience by allowing a track surface supporting vehicles to rotate as well as the central hub structure. The round ride 100 may be thought of as a normally supported vehicle as the track surface is located or positioned directly below the rotating vehicles such that a force(s) normal to the vehicle body may be used for vertical support. By rotating the track surface (surface 154) in the same or the opposite direction as the vehicles (vehicle 130, for example), the ride 100 may provide varying hill profiles and hill peaking frequencies as well as providing the passengers or riders with a feeling or sensation of waves pushing their vehicles along.

The round ride 100 includes a central hub structure 110 as may be common for round rides, and the central structure 110 includes a hub 112 that is rotated in one of two directions about a center or central (or rotation) axis 113 of the hub 112 and ride 100. The central structure 110 may be supported or mounted upon a foundation 102. A ride loading/unloading platform 104 may be provided in ride 100 to allow passengers to enter and exit passenger compartments of vehicles such as vehicle 130. The platform 104 extends about a location (or vehicle/arm radius) where the vehicles 130 are positioned at the end of support arms 122, and, in this embodiment, the vehicles 130 are supported upon a rotatable track 150 adjacent the platform 104.

Generally, as shown from the top view in FIG. 1, the ride 100 is a built upon or provided through use of a multi-arm round ride platform. With this in mind as one useful, but not limiting example, the ride 100 may include the central structure (or drive and support assembly) 110, which may be configured as for a typical round iron ride, e.g., may take the form of one of the drive and support assemblies designed and distributed by Zamperla Inc., 49 Fanny Road, Parsippany, N.J., USA or assemblies provided by other similar ride design and production companies. Often, such an assembly 110 only operates at relatively low speeds, $W_{Hub}$, of rotation for hub 112 about axis 113, such as less than about 20 revolutions per minute (RPM) and more typically less than about 10 RPM such as about 6 RPM in some cases. The control and actuation systems and methods described herein for inclusion in ride 100 are well suited for use with these low RPM drive assemblies 110 to provide a dynamic ride when combined with the separately or independently rotating track structure 150.

The ride 100 includes the drive and support assembly 110 with a center support structure 112 that is positioned upon a base. In contrast to most common round rides, the support structure or hub 112 does not house a plurality of arm actuators for pivoting booms or support arms 122. Instead, the arms 122 are coupled in a pivotal manner at proximal/inner ends 124 to support structure or hub 112 via a pivotal coupling that allows the arm 122 to freely pivot as the vehicle 130 is moved over a contoured track surface 154 (e.g., the arm 122 is allowed to respond to changes in elevation on the supporting surface 154 of the track structure rather than being moved up and down with an actuator device at hub 112). The support structure or hub 112 is also adapted to drive the ride 100 by rotating as shown with arrow 115 about a center axis 113. The speed at which it rotates may be relatively high such as up to 15 to 20 RPM or more but, in more common applications, the rotation 115 will be less than about 8 to 10 RPM such as about 6 RPM. Also, the rotation 115 may be a constant rate or it may be varied during the course of operating the ride 100. In some cases, the rotation 115 may be in either direction, but, more typically, the ride structure or hub 112 rotates 115 in a single (or first) direction, which allows the vehicles to be provided to better simulate forward flight or movement, while the track 150 may be rotated in a second direction (the same or opposite direction as the first direction of the hub rotation 115).

The ride 100 includes a plurality of vehicle support assemblies 120 that each includes a support or extension arm 122 that is pivotally mounted at a first or proximate end 124 to the ride structure or hub 112 via free-pivoting coupling 125. The arm 122 extends outward radially from the axis 113 and hub 112. The aim 122 is shown to be linear with a rectangular cross section, but many other configurations may be used to practice the ride 100, such as circular cross section arms with a non-linear shape (e.g., wavy, curved, or the like). The length of the arm 122 typically is 0 to 30 feet or more, and is chosen in this embodiment to position a supported vehicle 130 over a contoured, rotating track surface 154. In particular, a main function of the support arm 122 is to provide a pivotal connection between the hub 112 and a set of vehicles (such as vehicle 130 and the others shown in FIG. 1) such that the vehicle 130 rotates with the hub 112, e.g., in the same direction as the hub 112 and at a tangential velocity, $V_{Velocity}$, based on the hub rotation rate, $W_{Hub}$, and the length of the arm 122. The arms 120 are pivotally mounted at end 124 with coupling 125 such that the angle of the arm 120 relative to the base 114 and/or the ground may be changed during the ride operation as they pivot about end 124.

The vehicle 130 includes a body or passenger compartment 134 that is coupled to the second or distal end 126 of the support or extension arm 122. The coupling between arm 122 and body 134 may be rigid or may allow some pivoting or even rotation of the body 134 on the arm end 126. Each vehicle 130 includes running gear or vehicle support(s) 138 on a bottom surface/side of the body 134, and the running gear 138 acts to contact a track surface 154 and vertically support the body 134. In some embodiments, the running gear 138 includes one or more roller or wheel to provide a rolling engagement between the track surface 154 and the vehicle 130 but the running gear 138 may be nearly any type of support useful for supporting a ride vehicle upon a surface that moves relative to the vehicle. Guides or grooves (not shown) may be provided on the surface 154 for mating with running gear 138 or one or more rails may be provided on the surface 154 when the running gear is rollers (similar to a roller coaster), but this is not required.

Significantly, the round ride 100 includes a track structure or assembly 150 that is adapted for rotating independently from the huh 112. The track structure 150 includes a track 152 extending about the hub 112 and having a vertical axis that coincides with the center axis or rotation axis 113 of the hub 112. The track 152 may be thought of as a ring or similar shaped-structure (e.g., a donut-shaped, a washer-shaped, and so on) with a width that defines an upward-facing or exposed track (or vehicle support) surface 154. The track surface 154 is designed to provide a contact or support surface for the running gear 138 of the vehicles 130 of the ride 100, and the width may be relatively small or be several feet or more to suit the particular vehicle bodies 134 and running gear 138.

The track structure 150 includes a driver or drive mechanism(s) (not shown in FIG. 1) that are operated to rotate 155 the track 152 about the center or rotation axis 113. The rotation 155 may be CW or CCW about the axis 113 and may be in the same or an opposite direction to the rotation 115 of hub 112 about the same axis 113. The rotation 155 may be a rate, $W_{Track}$, that may be varied during the ride or be a fixed rate. The rotation rate, $W_{Track}$, may vary from about 0 to 10 RPM in some embodiments, with the use of a stationary track 152 typically only being used for short periods of time during the operation of the ride 100 such as at the beginning of a ride cycle (and, of course, at load/unload). As explained below, the rotation rate, $W_{Track}$, may be the same or differ from the rotation rate, $W_{Hub}$, of the hub 112 and may or may not be a multiple of the hub rate, $W_{Hub}$, to achieve a variety of effects and/or ride dynamics.

The track surface 154 may include planar portions but the unique ride effects are achieved by blending in planar portion or (low portions) with raised or higher elevation portions. In this manner, the track surface 154 is a contoured support surface for the vehicles 130 that supports the vehicles 130 at two or more elevations or heights above the loading platform 104 (or low portions of the track surface 154). The low portions may be planar with the raised portions being curved or sloped, as shown, or the opposite configuration may be used (with curved low portions and planar elevated/high portions (plateaus above valleys) or some combination thereof. The raised portions may be at the same height (or all at an equal height/elevation) above the lower portions or may be at two, three, or more differing heights (or some combination thereof).

In the relatively simple example shown in FIG. 1, the ride 100 has a track surface 154 with three raised portions or hills 160, 170, 180 that define a contoured surface for the vehicle 130 to travel over as the hub 122 rotates 115 about axis 113 (or the hub 112 is held still and the track 154 is rotated 155 about axis 113). With reference to hill 160, each raised portion or hill may include a central body or peak portion 164 that defines a high point or peak for the hill 160 (such as 1 to 6 feet or more in height). Leading and trailing portions 162, 166 are provided to create a ramped or sloped surface to make the change in elevation more gradual and smooth for the vehicle 130 as it leaves and returns to the lower portions of the track surface 154.

The length, height of peak portion or body 164, and configuration of leading and trailing portions 162, 166 may be widely varied to practice the invention, and FIG. 1 shows the three hills 160, 170, 180 having differing heights. As shown, hill 160 provides a first relatively small elevation gain, hill 170 provides a second and larger elevation gain, and hill 180 provides a third and much larger elevation gain for the vehicle 130 (e.g., when the vehicle 130 is supported by the track surface 154 on hill 180 it is higher than when supported on hills 160 and 170). The leading portions 162, 166 may be relatively long to provide a gradual increase in vehicle height (slow elevation gain per length of track surface 154) or be relatively short in length to provide a rapid increase in vehicle height (rapid elevation gain per length of track surface 154).

A further parameter for designing the track surface 154 is the number and separation of the hills/raised portions. The surface 154 needs to have at least one raised portion or hill (or elevation changing feature such as a valley), but two, three, four, or more may be used in ride 100. The hills 160, 170, 180 may be positioned to be equidistally separated on track surface 154 or, as shown, the separation between trailing and leading portions may be varied to achieve a less predictable, cyclic experience (e.g., have hills 160, 170 closer together than hills 170 and 180 and/or hills 180 and 160). For example, a track surface 154 may have several small "bumps" that only have little separation and then a much larger peak that stands alone (or with other hills/raised portions) at a greater distance from the last smaller hill 170 to provide a dynamic and exciting ride experience (to build up anticipation and/or add to unpredictability of the ride 100). In other cases, though, the hills may all be of the same height and design with variations achieved by the direction and/or speed, $W_{Track}$, of rotation of the track 150 relative to the hub 112 and its rotation parameters (direction and speed, $W_{Hub}$).

Figure 2:
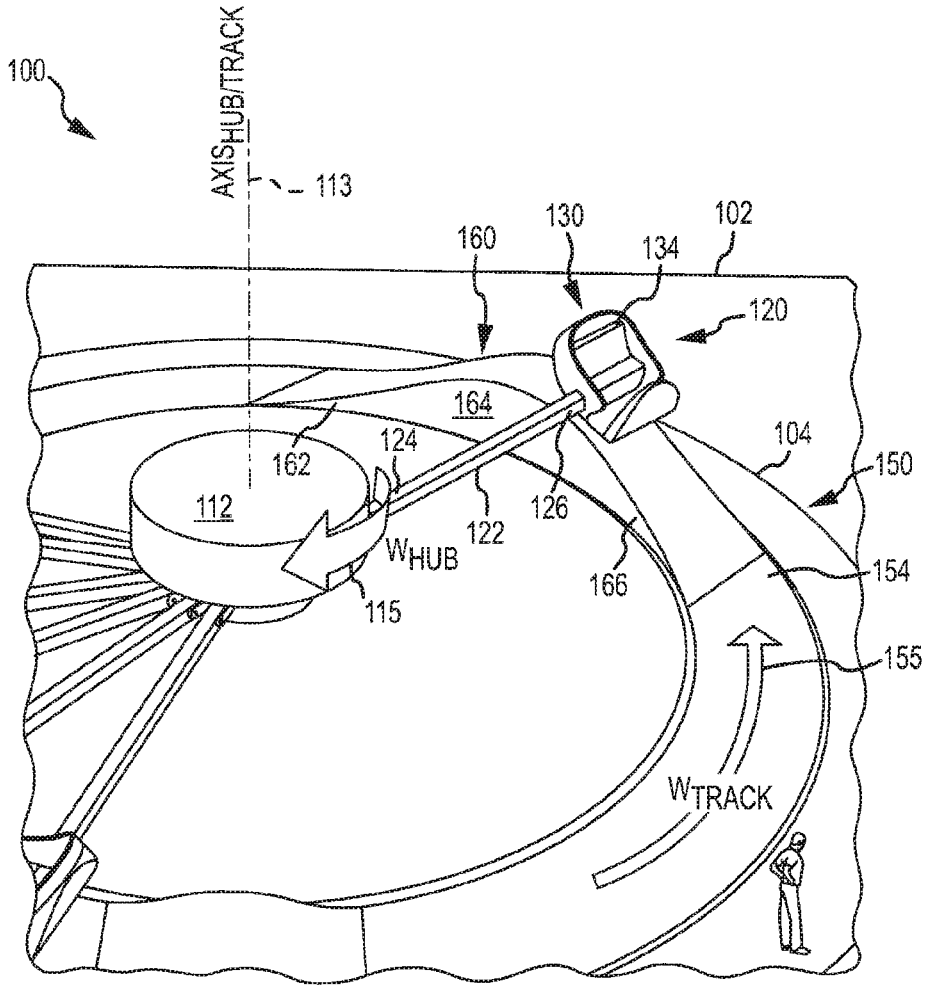
FIGS. 2 and 3 are close up (or more detailed) perspective views of the round ride of FIG. 1 showing only one of the vehicle support assemblies and their positioning while the hub is rotated in a first direction and while the track structure is concurrently (but independently) rotated in a second direction opposite the first direction, with the vehicle traveling over a raised portion or hill/peak element on the contoured track surface.

FIG. 2 illustrates a simplified view of the ride 100 showing vehicle support assembly 120 in isolation. In this operation example or state, the ride 100 is operated with the hub drive assembly (not shown) rotating 115 the hub 112 about the axis 113 in a CW direction at a hub velocity, $W_{Hub}$. The hub rotation 115 causes the pivotally connected arm 122 to also be rotated in the CW direction about axis 113 such that the vehicle body 134 at the arm end 126 as a tangential velocity defined by the hub velocity and the length of the arm 122, and this arm length combined with mounting location are selected to match the radius of the track, $R_{Track}$, such that the running gear 138 abuts or contacts the track surface 154 as the vehicle 130 travels about the axis 113.

In the ride 100 of FIG. 2, the track drive assembly (not shown) is operating to rotate 155 the track 152 in a CCW direction about axis 113 (e.g., in a second direction that is opposite the first rotation direction of the hub 112). When the track rotation rate, $W_{Track}$, about axis 113 is greater than zero, the track rotation 155 in the opposite direction causes the raised or hill portions such as hill 160 to support the vehicle 120 more often than if the track surface 154 were stationary. Further, the ride 100 may be controlled such that the track rotation rate, $W_{Track}$, is varied over the course of the ride such that the number of times the vehicle 134 travels over the hill 160 varies for at least some loops or rotation cycles of the hub 112. For example, the vehicle 130 may climb the hill 160 once in one rotation and twice in another loop (and at varying radial positions about the axis 113 such that the vehicle's higher points vary throughout the ride).

As shown, the vehicle body 134 approaches the hill or raised portion 160 of contoured track surface 154 from a planar portion and initially rides on leading portion 162 of the hill 160. The arm 122 pivots upward or through a vertical angle at end 124, which is pivotally connected via connector 125 to hub 112. The vehicle body 134 then continues to be further elevated as the body 134 (or its running gear 138) rides on the surface 154 of peak or body portion 164 of hill 160. The vehicle 130 achieves a maximum elevation gain for the hill 160 and then travels down the trailing portion 166 of hill 160 to a lower (optionally planar) portion of track surface 154 as the hub 112 and track 152 are concurrently rotated 115, 155 in opposite directions.

Figure 3:
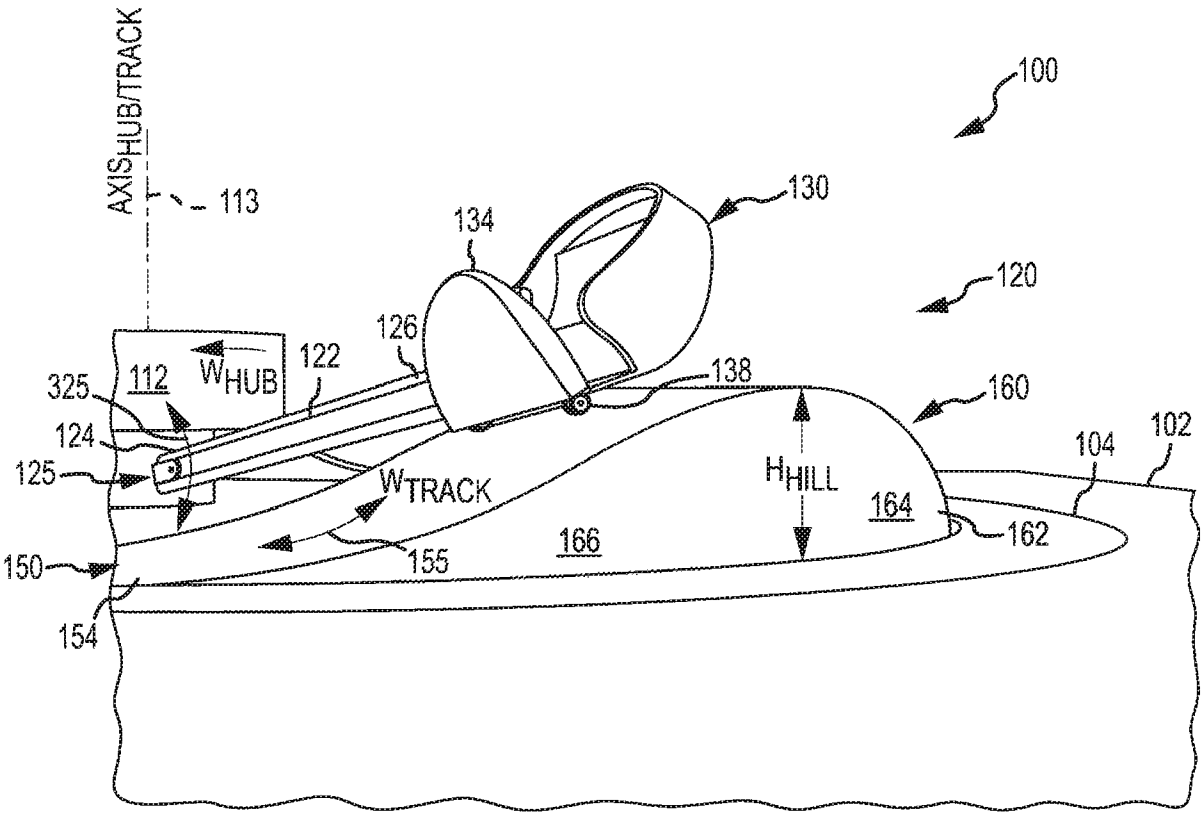

FIG. 3 shows in more detail the ride 100 shown in FIGS. 1 and 2. As shown, the arm 122 of vehicle support assembly 120 is pivotally coupled to the hub 112 at end 124 with pivot mount 125. This allows the arm 122 to pivot 325 at end 124 through a vertical angle (or angular range such as 0 to 60 degrees or the like) as the vehicle 130 travels over hill or raised portions such as hill 160. The amount of pivoting 325 is set, in part, by the height, $H_{Hill}$, of the peak or body portion 164 of the hill 160 as this defines the elevation change or gain for each raised portion of the track surface 154.

This may be widely varied to practice the ride 100 with a typical ride 100 having hills 160 with heights, $H_{Hill}$, ranging from 1 to 20 feet or more, and such changes in elevation may also be set based on rotation rates, $W_{Hub}$ and $W_{Track}$, to set an acceptable amount of thrill for an intended passenger set (i.e., to provide a ride for children or older riders that has more thrill). In FIG. 3, the rotation 155 of the track surface 154 is shown to be in either a CW or a CCW direction to emphasize that the ride 100 may be operated with the track 150 rotated in the same or a differing direction than the hub 112 (which is shown in FIG. 3 to be rotation in a CW direction about axis 113), FIG. 3 also shows that the running gear 138 may take the form of wheels abutting the track surface 154 and pivotally supported by an axle or the like on the bottom of vehicle body 134.

Figure 4:
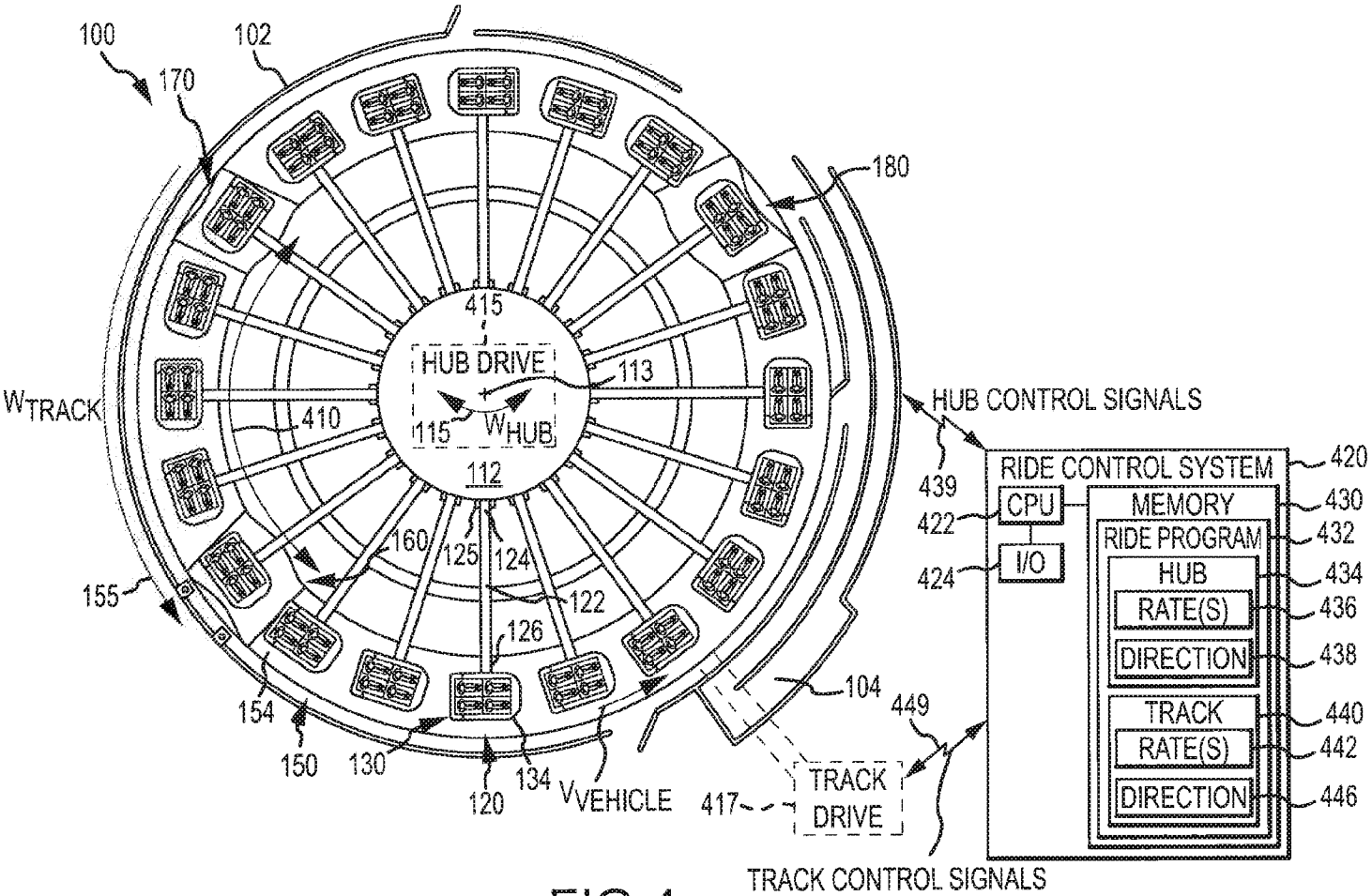
FIG. 4 illustrates more schematically the ride of FIGS. 1-3 with a top view showing use of a controller to selectively and independently operate a hub drive and a track drive to rotate the hub structure (and supported vehicles) and to rotate the track structure (both rotating about a central ride axis or rotation axis (i.e., the rotation axes are substantially vertical and coinciding))

FIG. 4 illustrates a top schematic view of the ride 100 of FIG. 1. The ride 100 is shown schematically to show that the ride 100 includes a hub drive 415 (or drive assembly) that operates to rotate 115 the hub 112 about the center vertical axis 113 at a particular rate, $W_{Hub}$, and in a particular direction (CW or CCW) during operation of the ride 100. This causes the vehicles 130 in each vehicle support assembly 120 to also rotate about axis 113 (as shown with arrow 410) and have a tangential velocity. As illustrates, the vehicles 130 are being rotated in the CCW direction with hub 112.

The track structure 150 of the ride 100 includes a track drive (or drive assembly) 417 that is independently operated relative to the hub drive 415 to rotate the track 152 and surface 154 in a CW or CCW direction about center vertical axis 113. As shown, the vehicles 130 are supported upon the contoured track surface 154 to have elevation changes as they move over hills 160, 170, 180 and back down to lower portions between such hills or raised portions. In this example of ride 100, the track drive 417 is operating to rotate 155 the track surface 154 in the CCW direction or in the same direction about axis 113 as the hub 112 is being rotated by hub drive 415. The use of a common rotation direction may be desirable for obtaining a unique ride experience such as delivering the feeling of a vehicle being pushed along by a wave rather than climbing a hill (e.g., when the track surface 154 moves faster than the vehicles 130 as shown by arrow 410).

The ride 100 includes a ride control system 420 to transmit control signals 439, 449 to the hub and track drives 415, 417 to control the rotation rates and rotation directions. The ride control system 420 may take the form of a computer or computer system with one or more hardware/software processors 422 managing input/output devices 424 useful for transmitting the signals 439, 449 and for receiving input from human operators (e.g., via a keyboard, a mouse, a touch-screen/pad, a graphical user interface displayed on a monitor, or the like) to control operation of the ride 100. The processor 422 further manages or accesses memory (or data storage) 430, and the human operator may use the I/O 424 to initiate a ride program 432 run by the processor in memory 430. The ride program 432 may define operating parameters for the hub 432 and for the track structure 440 such as by defining rotation rates 436, 442 and rotating directions 438, 446. Again, the rates 436, 442 may be the same or different and the rotating directions 438, 446 may be the same or different, and each of these parameters may be separately changed throughout a single ride operation or cycle of the ride 100 to achieve a desired ride experience. The ride program may be considered code in computer readable medium useful for causing a computer (such as ride control system) to perform particular functions such as to selectively transmit control signals 439, 449 in a wired or wireless manner to drives 415, 417 to independently control and operate the drives 415, 417.

Figure 5:
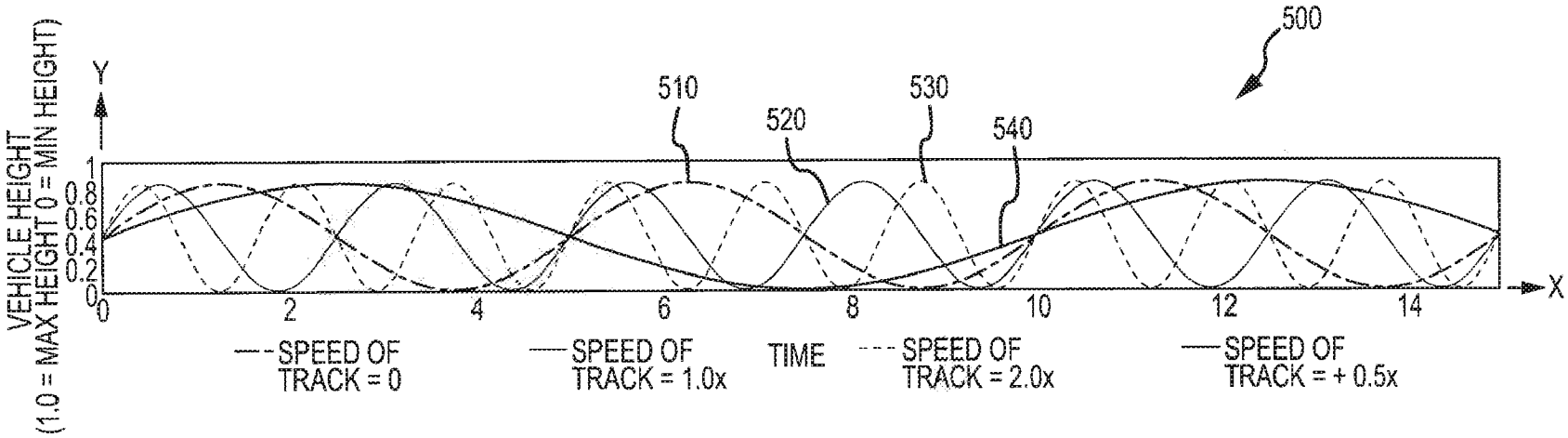
FIG. 5 is a graph showing the effects of varying the track speed or rotation rate and rotation direction on height of a vehicle (and when in a rotation the heights are experienced by the vehicle)

It may be useful at this point to describe the ride dynamics or experiences that may be achieved through the use of independently rotating hubs and track structures to move a vehicle through a ride profile. The ride profile may be thought of as a range of vehicle heights or elevations and the timing of the changes in height or rate of movement through this range(s) of heights. FIG. 5 illustrates a graph 500 showing vehicle heights on the Y-axis and time on the X-axis. A first line 510 illustrates changes in heights of a vehicle that may be provided over time when the track surface is not rotated or has a rotation rate of zero about the central axis while the hub is rotated at a particular rotation rate ("x"). In the graph 500, a height of zero may be considered a lowest elevation (such as a load/unload height in which a vehicle is position proximate to a loading/unloading platform or the like).

In contrast, line 520 illustrates a ride profile showing changes in vehicle heights over time when the track surface is rotated in the opposite direction as the hub and at the same rate (e.g., both are rotated at 5 RPM but in opposite directions). In this manner, the maximum height is more than once per revolution of the hub. Line 530 illustrates a ride profile for a vehicle when the track surface is rotated in the opposite direction and at a rotation rate that is twice that of the hub. A comparison of lines 520 and 530 shows that the frequency of moving the vehicle from the lowest to the highest ride elevation is significantly increased, which may be useful to vary the "thrill" aspect of a ride such as ride 100. Further, the ride experience may be made more unpredictable by rotating the track structure as shown by lines 510, 520, and 530 in the same ride such as by varying the speed of the track structure and/or the hub to achieve these ride profiles or various combinations of these ride profiles.

In some cases, it may be desirable to have the track structure rotate in the same direction as the hub but at a different rate. Such an operating mode is shown with line 540 that represents a ride profile when a track surface is rotated about the center axis in the same direction as the hub but at a non-multiple of hub rotation rate (e.g., 0.5 times the hub rate or "x"). A multiple of 2 to 5 or more could be used to cause the vehicle to feel as though it is being swept along by a wave. However, in some cases, it may be useful to select a non-multiple such that each rotation is somewhat different to avoid a ride passenger from sensing a repeating nature of a ride. Again, as with profiles 510, 520, 530, two or more relative rotation rates may be used within a single ride operation that includes a single rotation direction for the hub and track structure to achieve desired ride experiences, with the use of independently rotating hub and track structures providing a nearly limitless set of ride profiles for vehicles in a round ride.

One intent of the Doppler rotator (or ride 100) is to provide a simple ride mechanism. Another intent is to provide a passenger experience that varies over the course of the ride as opposed to the typical cyclic ride experience presently available. The arm support or hub assembly rotates about a center axis as does the running surface, which vertically supports (often with a normal force) the vehicles (directly via their running gear or indirectly via a surface contact member on the support arm). The arms allow vertical movement of the passenger compartments or vehicle bodies (e.g., no arm actuation required). The running surface of the track has hills and valleys (or a contour with varying elevations) to create vertical movement of the passenger compartments as they pass over different parts or portions of the running surface.

As discussed relative to FIG. 5 and graph 500, when the running surface speed is zero, the ride experience is cyclical and predictable. If the running surface, though, is then counter rotated relative to the vehicle rotation, the hills are effectively steeper and more closely spaced apart (when compared to the stationary track surface). If the running surface rotates in the same direction as the vehicle rotation, the hills are less steep and further apart (with steepness here being the rate of elevation gain over distance traveled by the vehicle and not absolute height of the hill/raised portions). When the running surface rotates in the same direction as the vehicle rotation and is faster than the vehicle, the hills "feel" like waves coming up from behind the vehicle and pushing the vehicle along the track surface. From off-board, viewers of the ride see a traveling wave moving either with or against the vehicle rotation, which provides another advantage and unique of the ride systems described herein.

The Doppler rotator ride system provides a simple low cost mechanism with two rotating assemblies and no individual arm rotation mechanisms (e.g., in ways, it is less complex than many existing round rides). There are few if any safety concerns with the drive mechanisms. If either or both rotating assemblies fail, the system still behaves in a safe manner. The arms may be relatively small (in cross section area, for example) as they do not need to support the full weight of the vehicle in a cantilevered manner relative to the hub mounting location, as the vehicle is at least partially supported by the running surface. The ride system provides interesting ride dynamics without the need for passenger control, which simplifies the vehicle body and control system(s) and also makes a 4 or more passenger vehicle practical that may double the capacity of many round rides.

Figure 6:
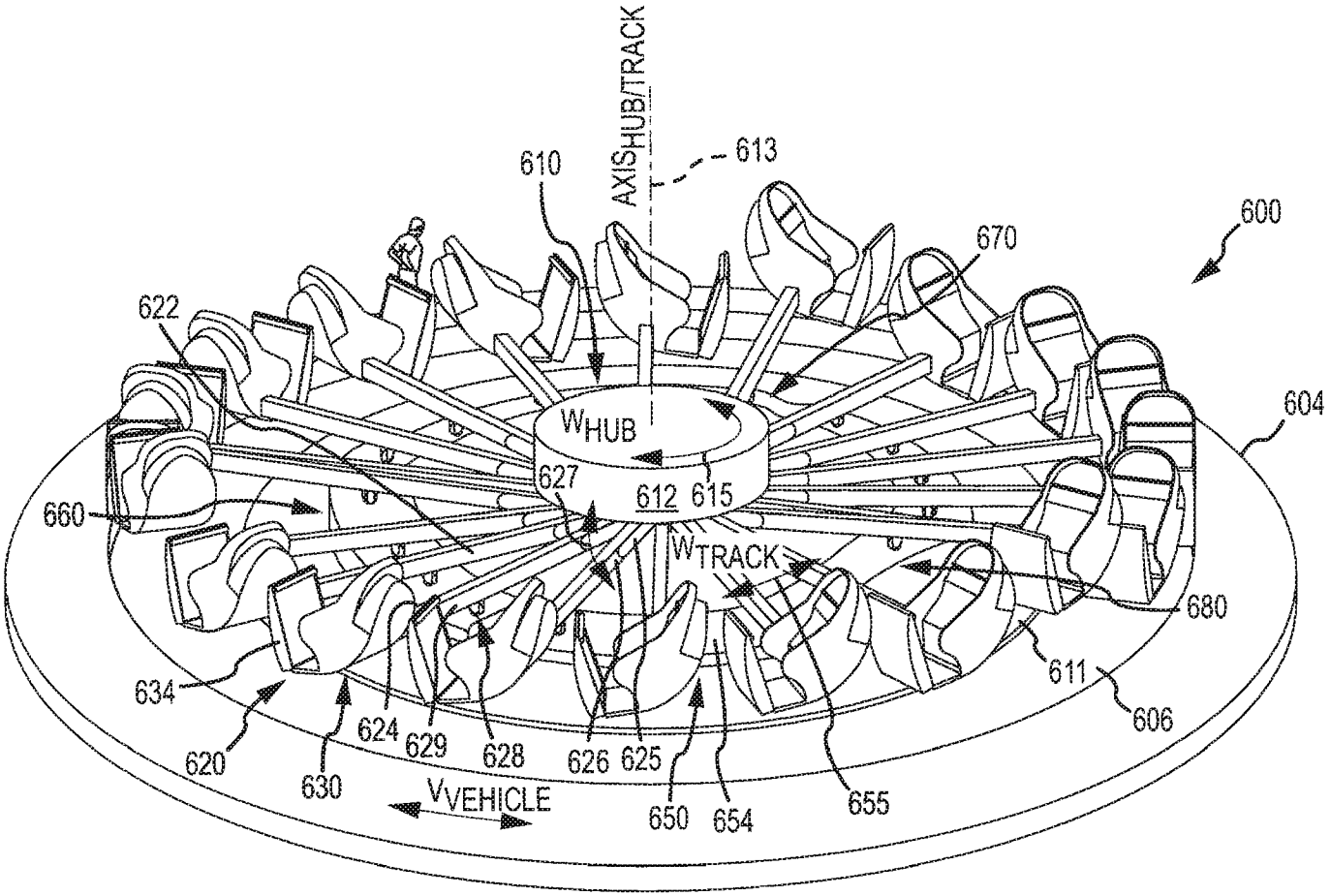
FIG. 6 is a perspective front view similar to FIG. 1 of a cantilevered arm embodiment of a round ride with independently rotated hub and track structures to provide a free flying experience for vehicle passengers.
Figure 7:
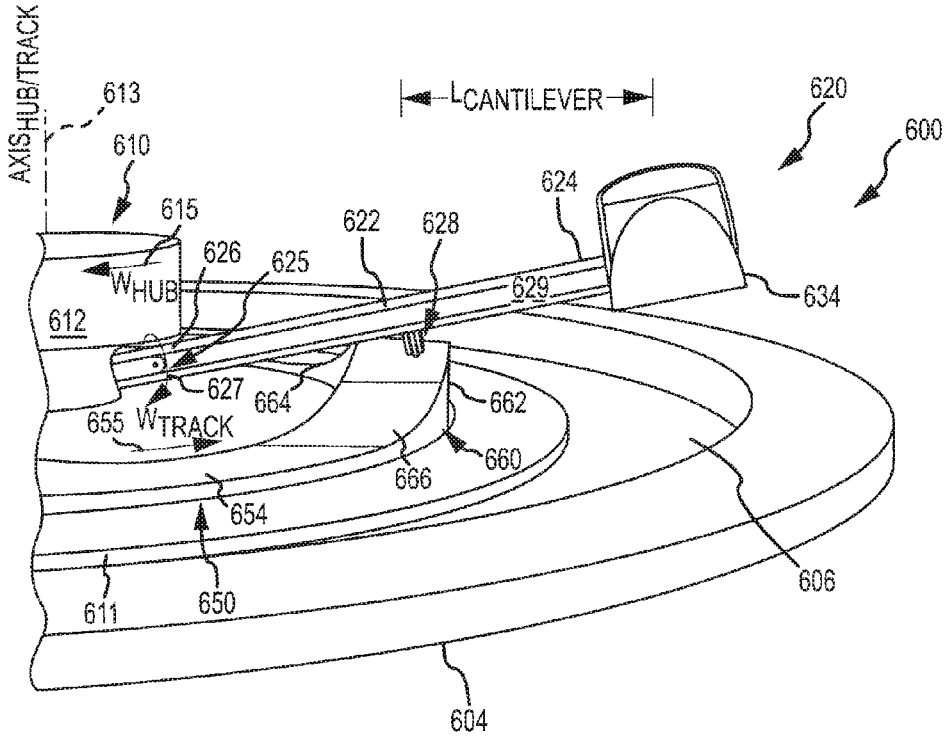
FIG. 7 is a close up (or more detailed) perspective view of the round ride of FIG. 6 showing only one of the vehicle support assemblies as the hub is rotated in a first direction and the track structure is rotated in a second direction opposite the first direction (in this non-limiting operating example) and with the vehicle traveling over a raised portion or hill/peak element on the contoured track surface.
Figure 8:
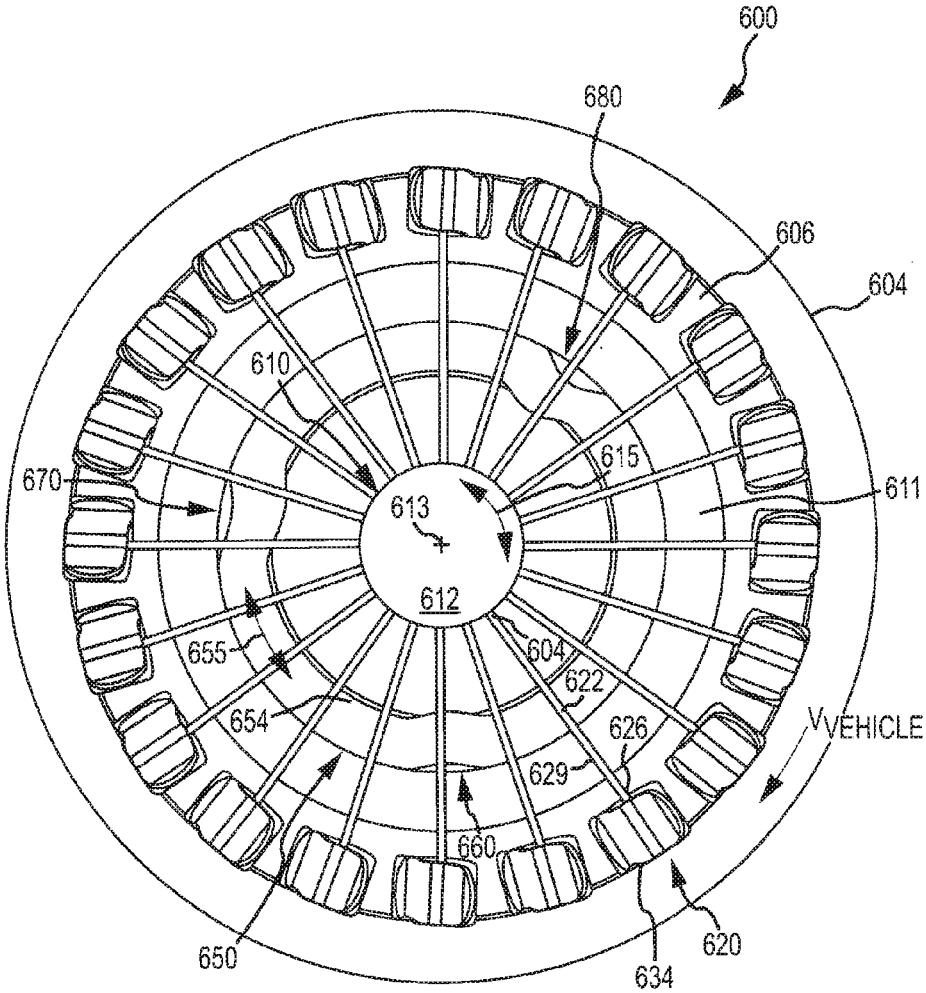
FIG. 8 illustrates more schematically the ride of FIGS. 6 and 7 with a top view showing the selective and independent rotation of the track structure and hub structure (both rotating about a central ride axis or rotation axis (i.e., the rotation axes are substantially vertical and coinciding)).

FIGS. 6-8 illustrates another Doppler rotator ride system 600 similar to ride 100 but with a free-flying vehicle experience. The free-flying aspect is achieved with a cantilevered support of the ride vehicles instead of having the vehicles supporting directly above the running or track surfaces. Specifically, the ride system 600 includes drive and support assembly 610 with a hub 612 that is rotated 615 about a vertical center axis 613 (e.g., by a hub drive mechanism not shown). The hub 612 may be rotated in either a CW or a CCW direction and at one or more rotation rates, $W_{Hub}$. The hub 612 and its drive may be supported on a foundation or platform 604 that provides a load/unload platform. A channel or valley 606 may be provided in platform/foundation 604 such as under the path followed by the vehicles 634 and this may be filled with water in some cases. The platform or foundation 604 may include a stationary or inner pedestal 611, which may act to support the drives for the hub 612 and/or the track structure 650, but, in either case, the pedestal 611 typically remains stationary while the track surface 654 and hub 612 independently rotate about axis 615.

The assembly 610 is configured to support a plurality of vehicle support assemblies on the hub 612 and to rotate these assemblies with hub 612. For example, vehicle support assembly 620 is includes in assembly 610 and includes a support arm 622 that supports a vehicle 630 at a first or free end 624. The vehicle 630 includes a passenger compartment or body 634 for receiving one, two, or more passengers, and the body 634 may be rigidly or pivotally supported on the end 624. The vehicle 630 has a tangential velocity, $V_{Vehicle}$, determined by the hub rotation rate, $W_{Hub}$, and the length of the arm 622 (the vehicle's radius relative to rotation axis 613). The arm 622 is pivotally attached at a second or inner end 626 to the hub 612 via pivotal coupling 625 so that the arm 622 and attached vehicle body 634 may pivot 627 vertically about connection end 626.

The ride system 600 includes a track structure 650 with a contoured track surface 654 with planar or lower/valley portions and hills or raised portions 660, 670, 680 spaced apart along the surface 654. The vehicle support assembly 620 includes a surface contact element (or running gear) 628 on the arm 622 at an intermediate point between the arm ends 624, 626. The track surface 654 is positioned below the arm 622 at a radius about the center axis 613 that is smaller than the vehicle radius defined in part by the length of the arm 622 (as measured between ends 624, 626) such that the arm contact element(s) or running gear 628 rides upon the contoured surface 654 as the hub 612 is rotated 615 about axis 613.

In this manner, the vehicle 630 is supported by a cantilevered portion 629 of the arm 622 extending outward a length, $L_{Cantilever}$, beyond the contact element 628 to the end 624 so as to provide a more free-flying ride experience. As with ride 100, the track surface 654 may be rotated 655 in either direction about axis 615 (the same or opposite direction as the hub 612) and at a rate, $W_{Track}$, that range from zero to some maximum amount and that is a multiple or non-multiple of the hub rotation rate, $W_{Hub}$. The ride 600 may be operated similar to ride 100 with a ride control system (see FIG. 4) and as described with reference to graph 500 in FIG. 5.

The ride system 600 may be thought of as an alternative to the ride 100 in which the arms engage a cam at a point inboard of the vehicles. In some embodiments of system 600, the cam or track structure 650 is raised (e.g., into a running position) and lowered (e.g., to move vehicles into a convenient load/unload position) by a lift or vertical-positioning mechanism (not shown). This simplifies load/unload operations as all the arms of the vehicle support assemblies comes to rest against down stops when the cam is lowered to put all the vehicles at the same elevation, e.g., adjacent to a load/unload platform provided by foundation 604.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, some embodiments utilize self-propelled vehicles that move along the track and that are typically not attached to support arms.

We claim:

1. A round ride system providing varying changes in elevation for passengers, comprising:

a central hub assembly with a hub and a hub drive rotating the hub about a central axis at a hub rotation rate, the hub assembly further including at least one support arm extending outward from the hub assembly;

a plurality of passenger vehicles with at least one of the vehicles is mounted proximate to an end of the support arm distal to the hub drive, wherein each of the support arms is pivotally mounted to the hub assembly for angular rotation to change a height of the corresponding vehicle with movement of the support arm; and a track structure with a ring-shape running surface extending about the central axis at a track radius and with a track drive rotating the running surface about the central axis at a track rotation rate, wherein the vehicles are vertically supported by the running surface and wherein the running surface and the hub are independently rotated about the central axis.

2. The system of claim 1, wherein the running surface is contoured to provide at least two surfaces with differing heights relative to a horizontal plane extending through the central axis.

3. The system of claim 1, wherein the running surface comprises at least two spaced apart, raised portions with first and second heights.

4. The system of claim 3, wherein the first and second heights differ.

5. The system of claim 1, wherein the hub drive is operable to rotate the hub about the central axis in a first direction and wherein the track drive is operable to rotate the hub about the central axis in a second direction that is opposite the first direction.

6. The system of claim 1, wherein the track rotation rate is a non-multiple of the hub rotation rate.

7. The system of claim 1, wherein the track rotation rate differs from the hub rotation rate.

8. The system of claim 1, wherein each of the vehicles are vertically supported by the running surface via running gear provided on each of the vehicles that contact the running surface.

9. The system of claim 1, wherein each of the vehicles are vertically supported by the running surface in a cantilevered manner by a contact element, provided on the support arm at a location inboard of the mounting end of the arm, that rides on the running surface.

10. A round ride, comprising:

a hub assembly including a hub and a hub drive rotating the hub about a center axis in a first direction and at a first rotation rate;

a vehicle support assembly including a support arm connected at a first end to the hub to rotate with the hub and to pivot in a vertical direction, wherein the vehicle support assembly further includes a passenger vehicle attached to a second end of the support arm; and a track assembly including a ring-shaped track with a contoured surface vertically supporting the passenger vehicle and including a track drive rotating the contoured surface about the center axis at a second rotation rate.

11. The round ride of claim 10, wherein the contoured surface is configured to include a plurality of raised portions and wherein the first rotation rate differs from the second rotation rate.

12. The round ride of claim 11, wherein at least two of the raised portions have differing heights.

13. The round ride of claim 10, wherein the track drive further operates to rotate the contoured surface at a third rotation rate differing from the second rotation rate, whereby the contoured surface rotates at two or more rotation rates during operation of the round ride.

14. The round ride of claim 10, wherein the track drive operates to rotate the contoured surface of the ring-shaped track in a direction about the center axis that is opposite of a rotation direction of the hub about the center axis.

15. A round ride, comprising:

a drive and support assembly including a hub rotatable about a central axis in a first direction and at a first rotation rate and at least one support arm extending outward from the hub, the support arm being pivotally coupled to the hub for vertical rotation;

a vehicle mounted to an end of the support arm distal to the hub; and a track structure including a track with a running surface extending about the central axis with a first portion having a first height and a second portion having a second height greater than the first portion, wherein the track structure further includes a track drive operating to rotate, independent of the rotation of the hub, the running surface about the central axis in a second direction and at a second rotation rate and wherein the support arm or the vehicle are vertically supported by the running surface, whereby the support arm moves from a first angular position to a second angular position as it travels over the first and second portions, respectively, to vary an elevation of the vehicle.

16. The round ride of claim 15, wherein the first and second directions of rotation are the same and the first and second rotation rates differ.

17. The round ride of claim 16, wherein the second rotation rate is a non-multiple of the first rotation rate.

18. The round ride of claim 16, wherein the second rotation rate is less than the first rotation rate.

19. The round ride of claim 18, wherein the second rotation rate is greater than the first rotation rate and is a non-multiple of the first rotation rate.

20. The round ride of claim 15, wherein the first and second directions of rotation differ.

* * * * *